United States Patent [19]

Moore

[11] Patent Number: 4,997,997

[45] Date of Patent: Mar. 5, 1991

[54] COILED ARTICLE RETAINER ASSEMBLY

[76] Inventor: Edward K. Moore, 2344 Homestead Rd., Santa Clara, Calif. 95050

[21] Appl. No.: 372,677

[22] Filed: Jun. 28, 1989

[51] Int. Cl.[5] ..... B65H 75/36

[52] U.S. Cl. ..... 191/12.2 R; 242/85.1; 239/276

[58] Field of Search ..... 242/85.1, 85; 191/12.2 R; 24/115 F, 115 H, 115 K, 129 R, 129 B, 71.1, 71.2, 71.3; 248/304–306; 239/195, 198, 273, 276

[56] References Cited

U.S. PATENT DOCUMENTS

| | | | |
|---|---|---|---|
| 1,058,925 | 4/1913 | Toegel | 242/85.1 |
| 2,470,212 | 5/1949 | Carlson | 242/85.1 |
| 3,290,453 | 12/1966 | Jensen | 242/85.1 |
| 3,837,448 | 9/1974 | Hagstrom | 191/12.2 R |
| 3,870,133 | 3/1975 | Brennenstuhl | 191/12.2 R |
| 4,688,739 | 8/1987 | Moore | 242/85.1 |
| 4,779,815 | 10/1988 | Moore et al. | 242/85.1 |
| 4,872,622 | 10/1989 | Mansfield | 242/85.1 |

*Primary Examiner*—Andres Kashnikow
*Assistant Examiner*—Christopher Trainor
*Attorney, Agent, or Firm*—The Dulin Law Firm

[57] ABSTRACT

A coiled article retainer assembly comprising a generally planar rectangular body, including a main body portion having an outlet member secured thereon for an electric cord, garden hose, or other like transmission member for initial power, fluid, or signal sources, secured thereon. The retainer assembly has two arms, spaced from and generally parallel to opposite side margins of the main body portion, defining an upper handle and a lower coiled article retaining slot. The retainer assembly is provided with a hook or hole at each opposite end margin for convenient storage by hanging on a nail, hook, rafter or the like. A keeper assembly, comprising a two way flap-type valve, is disposed at the open end of the retainer slot. The keeper assembly permits the paying in or out of individual coils by normal force exerted by hand, yet has sufficient resistance to restrain individual coils of a coiled article from falling out of a fully loaded slot due the weight of the coils when the retainer assembly is stored or used in the normal "keeper down" position. An alternate embodiment provides for a light source secured to the outlet for convenience of the user at the job site. Another alternate embodiment combines the coiled article retainer framework with a sprinkler head for use with a garden hose. The framework may also have a detachable stand for stabilizing the sprinkler head when in use at the job site.

26 Claims, 2 Drawing Sheets

COILED ARTICLE RETAINER ASSEMBLY

FIELD

The present invention relates generally to apparatus for storing and feeding coiled members. More particularly, the invention relates to a portable coiled article retainer assembly in combination with a water or electric power relaying distribution unit, that in turn is connected with a terminal end of a coiled article.

BACKGROUND

There are numerous devices in the prior art for storing, transporting, and for paying out coiled articles such as electrical cords, garden hoses, rope and the like.

Examples of recent improvements to apparatus for supporting and retaining coiled members may be seen by reference to my earlier issued U.S. patents. U.S. Pat. No. 4,688,739 (Moore, 1987) discloses a coiled member support and retention apparatus wherein the apparatus comprises a one-piece, apertured framework having an elongated longitudinal slot for receiving portions of a coiled member medial of its enlarged terminal ends. An example of such a coiled member is an electrical cord. The longitudinal slot is dimensioned such that the width of the slot is less than twice the diameter of the intermediate portion of the coiled member to permit orderly storage of the coiled member. Adjacent coils are prevented from passing over each other in the slot (cross-coiling). Likewise, unspooling (lateral passage) of the enlarged terminal members of the coiled members are prevented from passing laterally through the elongated slot A spring-biased detente is positioned at the open end of the elongated slot to prevent the coiled member from entering or exiting the elongated slot unintentionally. A sufficient force, applicable by hand, is necessary to overcome the spring detente. The aperture in the frame work is dimensioned to permit the framework to be held by hand.

My second U.S. Pat. No. 4,779,815 (Moore et al , 1988), discloses a similar coiled article retaining device having improved coil retaining means comprising two opposed flexible tang members positioned at the open end of the elongated slot. The flexible tang members project into the elongated coil slot, and yieldingly permit insertion and removal of successive loops from and into the elongated slot.

The above two references permit feeding and extraction of coiled articles and prevent the unintended uncoiling and unspooling of a coiled article since a terminal end member of the article will not pass laterally through the elongated slot. In addition, the coiled articles may be stored in either a vertical or horizontal orientation.

Despite the convenience afforded by these devices for storing and feeding coiled members, the user of the coiled article may also need at the work site a water or power relaying distributing device, such as a multi-plug power outlet in the case of an electric cord or a sprinkler head, etc., in the case of a garden hose. There is thus a great need in the art for a combined handheld portable coiled article retainer with a water or power relaying and/or distributing device.

THE INVENTION

OBJECTS:

It is among the objects of this invention to provide an improved, multi-functional coiled article retainer device.

It is another object of this invention to provide an improved coiled article retainer which has an improved and simple keeper at the coil slot entrance It is another object of this invention to provide an improved coiled article retainer which includes built-in means for relaying or distributing power, or fluid, such as electric current, water, gas or the like.

It is another object of this invention to provide an improved coiled article retainer which combines a coil retention feature with a multi-plug electric outlet, with or without a light source.

It is another object to provide an improved coiled article retainer which combines a coil retention feature with a water distribution or directing element such as a sprinkler head.

Still other objects will be evident from the specification and claims.

DRAWINGS

SUMMARY

The coil retaining assembly of this invention comprises a generally planar body of generally rectangular configuration having arms spaced from and generally parallel to each side margin thereof to define a lower article-retaining slot and an upper handle. The body portion may have holes or other means for hanging the unit from a hook, nail or other hanger member. A keeper assembly is disposed at the mouth of the coil retaining slot, and comprises a flexible flap member, preferably of rubber, generally rectangular in configuration secured by a rigid stop, which is generally a planar metal tab. The rubber flap is sandwiched between the metal stop and the outboard end of the coil retaining arm. The arm is also notched adjacent the outboard end to permit the flap to bend more easily when an article to be coiled onto the retaining assembly is introduced into the slot and when it is removed from the slot. The stiffness of the rubber flap and the projection of the metal stop partway into the mouth of the slot are selected in dimension to permit coils of the article to be introduced into the slot, but preventing them from falling out under their own weight by gravity when the unit is held with the keeper assembly downward In addition, an essential part of the assembly of this invention comprises providing a power or fluid distribution or transfer unit mounted in conjunction with the main body portion of the coil retainer assembly A distribution or transfer unit includes at least one outlet of a power source. For example, an electrical multi-plug outlet, optionally having a resettable fuse and/or light, or a sprinkler may be mounted on the main body portion.

Thus, when an electrical extension cord is coiled on the coil retaining unit, when in use, the male plug may be plugged into the wall and the user can carry the unit by the handle extracting coil after coil to whatever length is needed. The remaining coils may remain retained in the slot. The multi-plug outlets are then available for plugging-in a plurality of electrical tools or appliances at the job site. Optionally an electric light source is also mounted on the main body portion.

Similarly, where a hose is being kept, it can be uncoiled loop by loop and then the unit placed on the ground where the sprinkler is desired. In this embodiment, an arcuate support member may be removably positioned on the base of the slot to help in holding the unit upright. Optionally a hose shut-off timer may be mounted on the main body portion.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
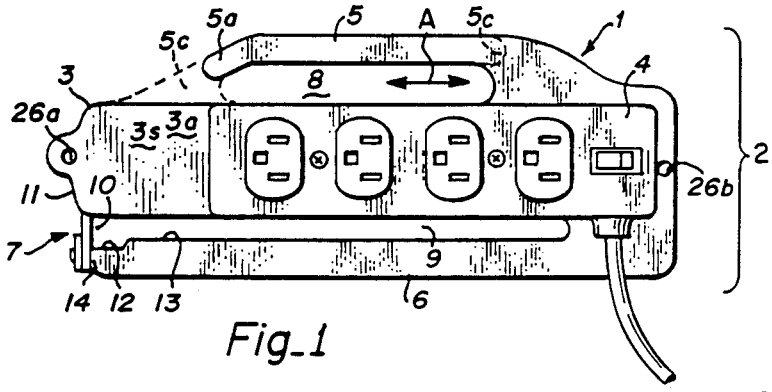
FIG. 1 is a side elevation view of the improved coiled article retainer assembly in accord with the present invention combining a multi-plug electric outlet with a coil retainer assembly.
Figure 2:
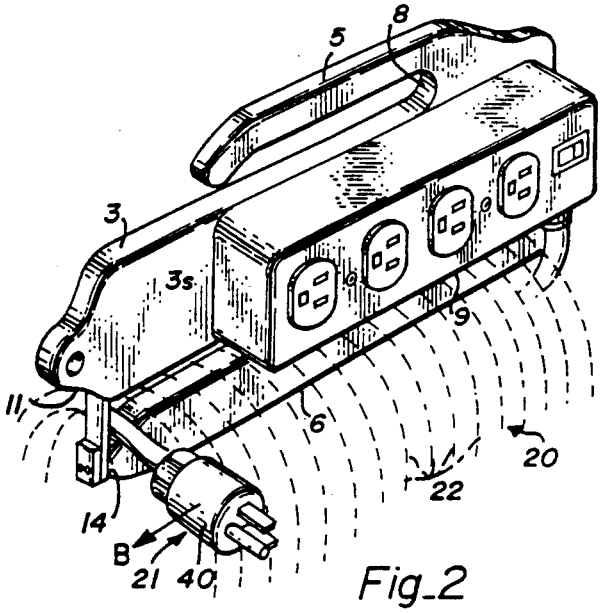
FIGS. 2 and 3 are perspective views of the coiled article retainer assembly of FIG. 1 showing an electric cord in phantom, FIG. 2 showing the coils in the carry position, and FIG. 3 in one storage position.
Figure 3:
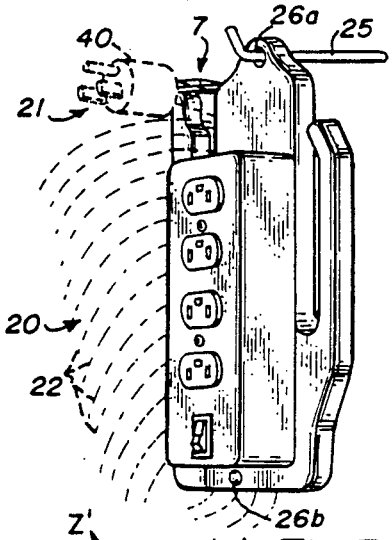

Referring to FIG. 1, the coiled article retainer assembly of this invention is designated generally by reference numeral 1. The preferred best mode of the invention comprises a unitary framework 2 having a main body 3 with a flat surface 3*s* and a multi-plug electric power outlet 4 secured thereon or built integrally therein. The framework 2 further comprises a handle portion 5, a storage arm 6, and a closure (keeper) assembly 7. While the preferred embodiment, as shown in FIGS. 1–3, discloses a multi-plug electric power outlet 4 secured to the framework 2, it is understood that "outlet" means any other like means for selectively delivering a power, fluid or signal source, including, but not limited to gas, fluid, electricity, TV signals, and microwave transmissions. What follows is a description of the above mentioned elements and the functioning of the entire assembly As is best seen in FIGS. 1 and 2, the handle 5 permits carrying and handling by the user, and is defined by an elongated relieved area 8 which separates it laterally from the main body 3. The relieved area 8 is sufficiently open to permit the fingers of the operator's gloved hand to wrap around the handle 5 without bashing his or her knuckles against the main body 3. While the relieved area 8 of FIGS. 1–4, 6, and 7, is shown generally as a elongated slot, it is understood that the relieved area 8 may also be an enlarged hole, elongated aperture, or other like configuration suitable to permit a comfortable grasp by the user's hand. The open, "arm" configuration shown is preferred so the handle 5 may also function as a retainer arm, e.g. for hanging the unit from a belt, on a hook or nail, or on any other appropriately configured support means. Where this function is desired, the handle opening may be reversed, so that a continuous web of the framework material 5*e* joins between 3*a* and 5*a*, and the opening is placed adjacent the right end, with the handle terminating at 5*c*, with 5*d* being removed. The handle arm thus has its slot 8 opening at the right while the coil arm orientation is reversed, with the opening to the left (as seen in FIG. 1). Similarly, the handle unit 5 may be of uniform width and thickness along its longitudinal axis, or specially contoured to fit the grip of a user's hand. The slot 8 is preferably elongated so that the user may comfortably balance the unit, depending on the number and weight of coils, by shifting his/her hand forward (to the left in FIG. 1), or back (to the right), as shown by arrow A.

The storage arm 6, which is formed as part of the framework 2, is disposed adjacent the main body 3 opposite the handle 5 and is further defined by an elongated slot 9. The storage arm 6 includes a relieved notch 12 disposed in the inner storage arm surface 13 adjacent the terminal end (the mouth) 14 (see FIGS. 1 and 5). The elongated coiled article slot 9 runs substantially the length of the framework 2, and its opening 10 is defined between the left marginal edge 11 of the main body 3 and the end 14 of the storage arm 6.

As is best seen in FIGS. 2 and 3, the elongated slot 9 functions to store sequential coils 22 of a coiled article 20 along the entire length of the storage unit 6 in an orderly fashion. Accordingly, the elongated slot 9 is dimensioned such that the width of the slot is less than twice the diameter of the intermediate portion of the coiled member 20. This provides a narrow slot that will slidingly accommodate single sequential coils 22 (shown in phantom) of the running length of the coiled member 20 but will not permit cross-coiling or lateral passage (unspooling) of the terminal end 21 of the coiled article 20 laterally through the elongated slot 9.

FIG. 3 shows how the coiled article retainer assembly of this invention may be stored by hanging the assembly 1 on a conventional storage hook or nail through hole 26 of the framework 2. The assembly 1 may be hung from a ceiling, rafter, on a wall, or other like place for convenient out-of-the-way storage. It may hung with the keeper assembly up, but is preferably hung keeper down so coils may be easily pulled out as need while the unit is hung on support hook 25.

Figure 4:
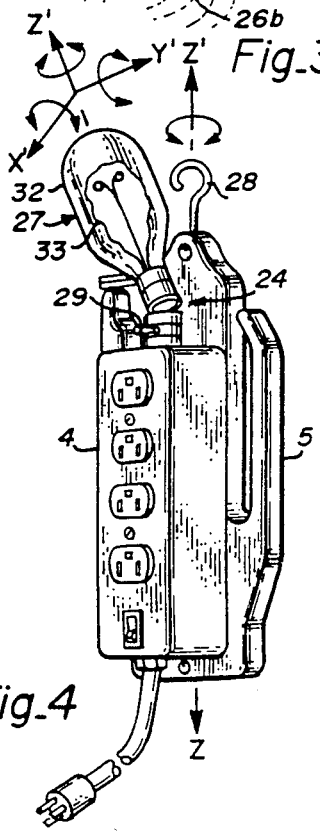
FIG. 4 is a perspective view of a first alternate embodiment of an improved coiled article retainer of this invention combined with a light source and multi-plug electric outlet.

In the alternative, the coiled article retainer assembly of this invention may also be provided with other means for storage or suspension, such as a hook or spring-biased clamp. FIG. 4 shows an alternate embodiment wherein the framework 2 has a hook 28 and a multi-plug electric outlet 4 with an adjoining light source 27 which may include reflector/shieldings 32 and light bulb 33 secured thereto. The entire unit is capable of being suspended at the job site. Such an embodiment is particularly useful for night time use or when the job site is located in an area with inadequate ambient light. A button 29 may be provided on the light source to regulate the desired brightness of the light (or whether any light is even necessary). Also, the hook 28 (or spring biased clamp) and/or light source 27 may swivel or have a universal joint 24 incorporated therein for a wide range of motion (see directional arrows about the $x^1y^1z^1$ coordinate axis) independent of the framework 2 and/or the multi-plug outlet 4. This would permit the user to aim the light source where needed.

Figure 5:
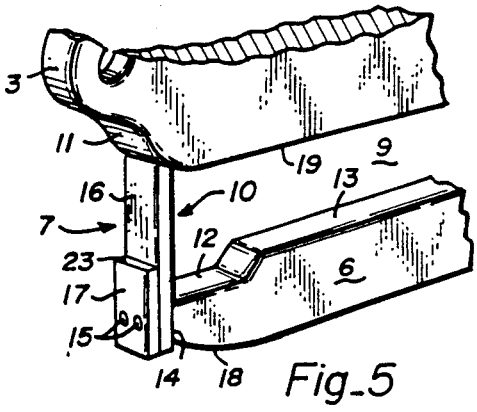
FIG. 5 is an enlarged partial view in perspective showing the detail of the keeper assembly at the mouth of the coil slot.

Referring now to FIG. 5, the entrance of the elongated slot 9 is controlled by the closure (keeper) assembly 7. The closure assembly comprises a somewhat flexible rubber flap 16 and a rigid stop 17, and is secured to the terminal end 14 of storage arm 6 by means of one or more screws 15. The flexible rubber flap 16 and stop 17 forms a closure assembly to the elongated slot 9 extending from the outer (lower) marginal edge 18 of storage arm 6 to the inner body surface 19 of the main body 3, i.e. across mouth 10 of slot 9.

To assemble the closure unit 7, the flexible rubber flap 16 is first positioned so that its length covers the width of slot opening 10. The free end of the flap should contact the inner body surface 19 of slot 9 and the fixed end portion may cover substantially the entire terminal edge 14 of the storage unit arm 6. The stop 17, being of shorter length, is then laid on top of the flexible rubber flap 16 having the edges of its fixed end substantially flush with that of the flexible flap 16. The screws 15 are then threaded through selected holes of the keeper 17 and rubber flap 16 at their fixed ends and thereby securing both pieces to the storage unit arm 6.

Figure 8:
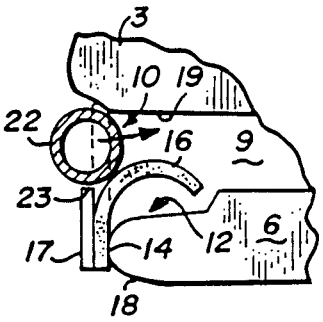
FIG. 8 shows the operation of the closure assembly.

The upper free end 23 of the stop 17 extends a small distance into the slot mouth 10 in order to provide adequate support and resistance properties to the rubber flap 16. As a general guide, the optimum extension or overhang of the stop 17 into the slot opening 10 exists where the upper end 23 of the inwardly directed end of the stop 17 is no lower than being substantially vertically aligned and in the same plane as inner storage arm surface 13 of the storage arm 6. That is, end 23 is co-planar with or above inner storage arm surface 13 to provide resistance to the flap 16 in bending to the left (outward, during uncoiling). As best seen in FIG. 8, the relieved notch 12 being lower than upper end 23 permits the flap to bend more easily to the right (inward for coiling). This differential stop overhang gives adequate support and resistance characteristics to the flexible rubber flap 16 while permitting passage of sequential coils 22 into and out of the slot opening 10 past the closure unit 7.

A longer stop 17 (greater extension or overhang into the mouth 10) may be desirable under certain operating conditions, e.g. for greater support to the flexible rubber flap with use of heavier coiled members. The overhang length is limited by the coiled member diameter and the thickness of the flexible rubber flap. This is, the mouth opening left between the upper surface of flap 16, when bent to the left over the stop 17, and the inner body surface 19 must be at least the diameter of the coiled article 20, else the coil cannot be removed from the slot without removing the stop 17, or first bending the flap 16 to the right, or unless the coil is compressible (as in the case of a garden hose).

The stop overhang and flap stiffness needs to be chosen to permit hanging the retainer assembly with the keeper down, that is (referring to FIG. 3) hung from hook 25 through hole **26*b*. With proper stiffness and overhang the coils are retained under their accumulated weight, yet with an appropriate tug on the coil, one coil at a time may be released from the unit. For this reason the handle orientation (mouth to the left) and hole 26*b* on the right end is preferred, so sequential coiling and uncoiling can be accomplished in the field, even when the handle is hooked over something (belt, side of garden cart, etc). The stop overhang limits above described are adequate to insure against inadvertent loss of coils from the device For example, when the coiled article retainer assembly is stored "keeper down" or used in that position, the sufficiently force-resistant keeper assembly of this invention prevents the coiled member 20 from spilling out of the elongated slot 9** due to its own weight.

The functioning of the storage unit 6 is best described with reference to FIGS. 2 and 5. When the coiled article is to be removed from coiled storage, the outboard terminal element, here a male plug 40 of an electric cord, is grasped and pulled outwardly in the direction of arrow B. A first loop of a coiled article will be moved toward the slot opening and come into contact with the flexible rubber flap 16. Continued application of force on the free end of the coiled article will result in the restraining force of the closure unit 7 being overcome. In overcoming the restraining force, the flexible rubber flap 16 is doubled-over backwards (to the left) from the pulling of the first loop of the coiled article outward from the elongated slot 9. Once the first loop is cleared of the closure unit 7, the flexible rubber flap 16 returns to its closed vertical position Continued application of force on the free end of the coiled article (or next adjacent stored coil) will result in the paying out in one direction of successive loops, until whatever amount (or the entirety) has been removed from the elongated slot 9.

FIG. 8 shows the reverse, the storage of a sequential coils 22. Since the relieved notch 12 is lower than upper end 23 of stop 17, the flap 16 bends easily, permitting entry of the coil 22 into slot 9. The diameter of coil 22 should be, unless compressible, no more than distance between end 23 and inner body surface 19 less the thickness of flap 16.

Figure 6:
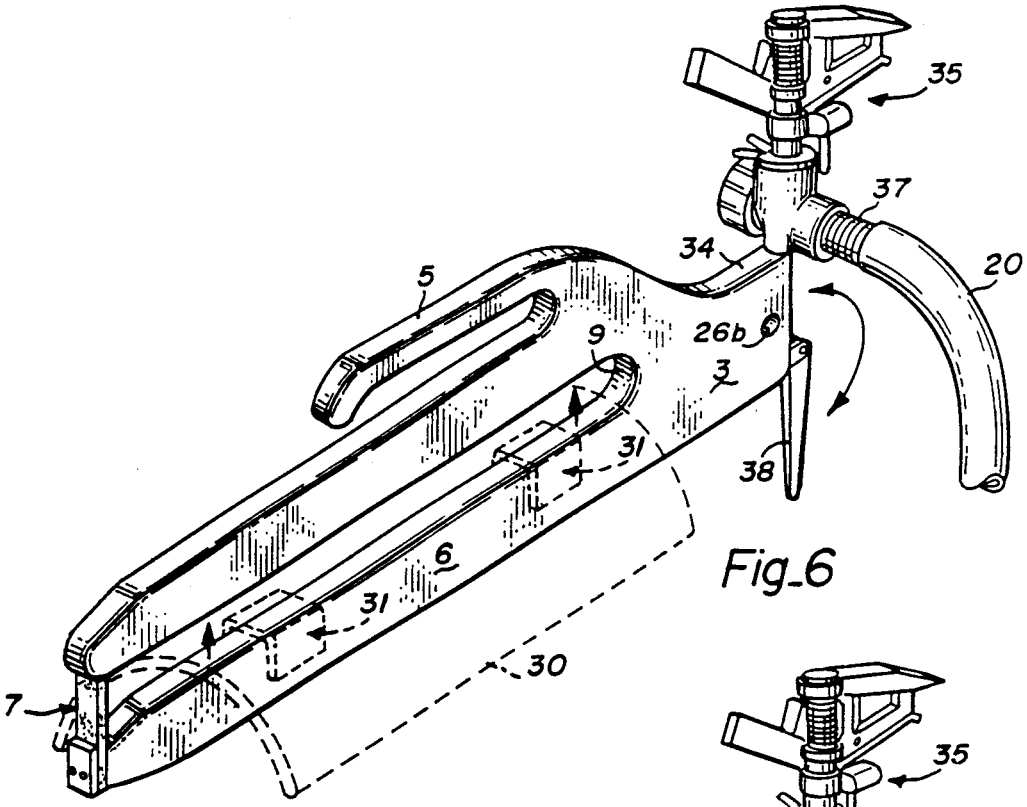
FIG. 6 is perspective view of a second alternate embodiment of an improved coiled article retainer of this invention combined with a sprinkler head showing a detachable stand in phantom.
Figure 7:
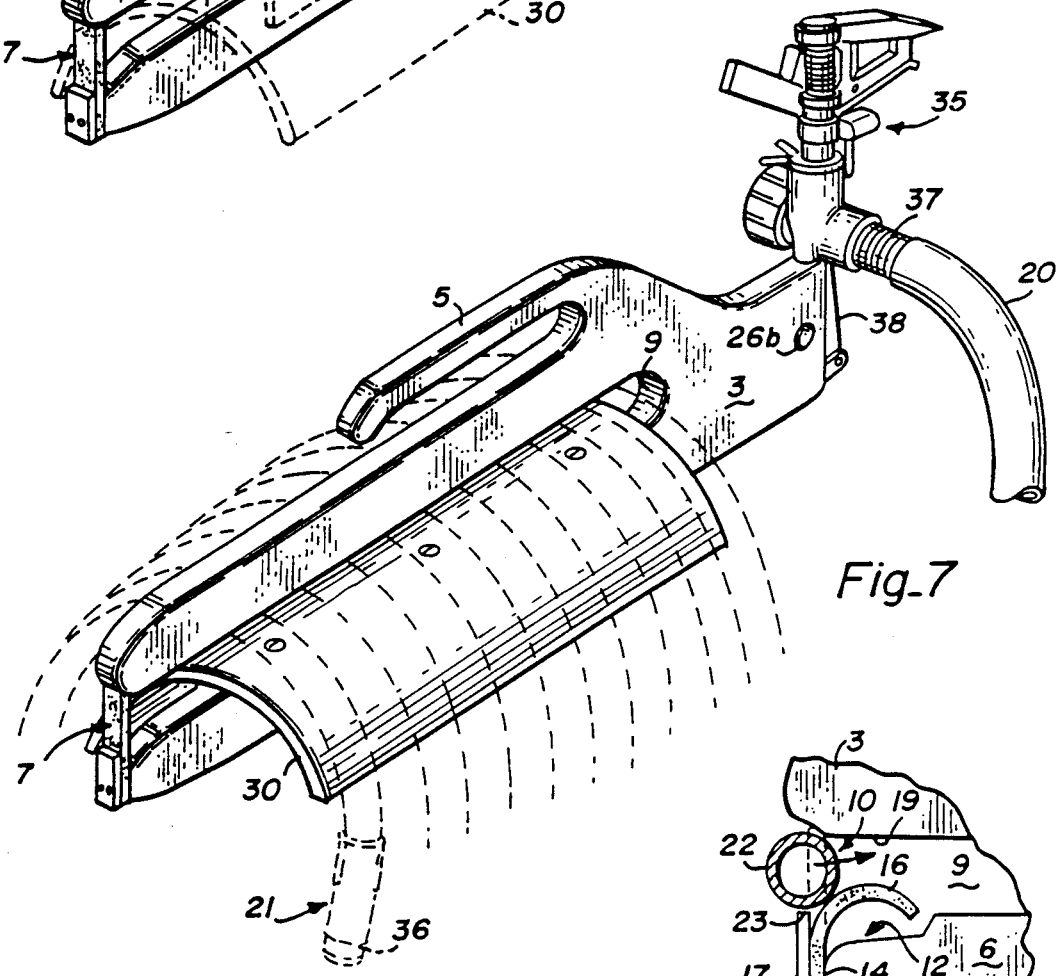
FIG. 7 is a perspective view of the second alternate embodiment of FIG. 6 showing a coiled garden hose in phantom in the carry position.

FIGS. 6 and 7 show another alternate embodiment to the coiled article retainer assembly of this invention. In this embodiment, the coiled member 20 is a garden hose having one terminal end attached to a sprinkler head 35 which, in turn is securely fastened to the body 3 preferably along the top edge 34, aft of the handle unit 5. Successive coils of the coiled member 20 are insertable into the elongated slot 9 to secure the coiled garden hose in position The operation is substantially identical to that of FIGS. 2 and 5, the only difference being that the framework 2 may be left on the ground unattended, as it is stabilized by support stand 30. As is best seen in FIG. 6, the support stand 30 may be detachable by means of specially adapted clips 31 disposed on the underside of the support stand and adapted to secure the support stand to the storage arm 6 Note also the optional hinged retainer spike 38 which may be folded up against the end to the body 3 when stored (FIG. 7) or pressed down into the earth to help retain the sprinkler in position (FIG. 6). FIG. 7 also shows the other end of the hose 36. The support stand's arcuate shape also helps maintain the hose coil of appreciable diameter so no kink is "set" into the hose as it ages.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. In a coiled article retaining assembly having a rigid body adapted to removably retain a separate, unconnected coiled article, said coiled article having a first terminal end member adapted to be disconnectably connectable to an initial power, fluid or signal source, an intermediate coilable portion, and a second terminal end member being adapted to serve as a remote outlet at a delivery site, the improvement comprising in operative combination therewith (a) a generally rectangular main body portion having opposed, spaced side margins and forward and rearward end margins including at least one substantially flat main body surface;

(b) a handle unit disposed along a first of said side margins of said main body portion;

(c) means for storing the article coils disposed adjacent a second of said side margins;

(d) said coiled article storage means comprising an arm having a first end connected to said main body adjacent said rearward end margin, and a second, unconnected terminal end disposed adjacent said forward end margin of said main body;

(e) said arm having an inner surface being spaced from and generally parallel to said second side margin to form a slot, said slot extending along a substantial length of said second side margin;

(f) said slot having a width defined between an inner face of said arm and said second side margin less than twice the diameter of said coiled article intermediate portion to permit orderly storage, prevent cross coiling of adjacent coils and prevent lateral passage of said first, enlarged terminal end member of the coiled article through the slot;

(g) said slot having an opening adjacent said forward end margin of said main body portion including means for regulating coil passage into or out of said slot; and (h) said coil passage regulating means being a flap-type keeper assembly having a bi-directional differential coil insertion/removal resistance, which resistance is less for coil insertion than coil removal, said coil removal resistance including a restraining force sufficient to prevent said stored coiled article from spilling out of said slot due to its own weight when said assembly is in an inverted, keeper-down position, but said coil removal restraining force being easily overcome by a minimal additional force provided by a user to permit coil by coil metering out of said coiled article without total unloading of all coils at once.

2. An improved coiled article retaining assembly as in claim 1 wherein:

(a) said handle unit includes an aperture sufficiently elongated to permit a change of carrying positions for balancing said article retaining assembly over a range of coil load distributions.

3. An improved coiled article retaining assembly as in claim 1 wherein:

(a) a said keeper assembly comprises in operative combination;

(i) a flexible flap member having a first, fixed end associated with said terminal end of said arm and a second free end extending inward from said arm toward said main body, said flap being dimensioned to provide a bendable cover for said slot;

(ii) a rigid keeper member having a first fixed end substantially coordinate with said fixed end of said flap member and a second free end extending inward from said arm a sufficient distance into said slot width to provide bending resistance to said flexible flap member while permitting individual coils of said coiled article to pass through said slot opening;

(iii) means for securing said first, fixed ends of said flap and said keeper to said terminal end of said storage arm; and (iv) a relieved notch area in said inner surface of said arm disposed adjacent the slot opening, said notch area being dimensioned to receive said flap upon bending of the flap inward during the insertion of said coils into said slot.

4. An improved coiled article retaining assembly as in claim 3 wherein:

(a) said securing means is adapted to permit replacement of worn flaps.

5. An improved coiled article retaining assembly as in claim 3 which includes:

(a) means for suspending said coiled article retaining assembly disposed adjacent at least one end margin of said body, to permit hanging said assembly during storage or use.

6. An improved coiled article retaining assembly as in claim 5 wherein said suspending means is a hole.

7. An improved coiled article retaining assembly as in claim 5 wherein said suspending means is a hook.

8. An improved coiled article retaining assembly as in claim 1 which comprises in operative combination therewith:

(a) means for distribution of said power, fluid or signal article from said source; and (b) said distribution means being disposed in association with and securable to said body to provide at least one portable outlet for said power, fluid, or signal at said delivery site.

9. An improved coiled article retaining assembly as in claim 5 which comprises in operative combination therewith:

(a) means for distribution of said power, fluid or signal article from said source; and (b) said distribution means being disposed in association with and securable to said body to provide at least one portable outlet for said power, fluid or signal at said delivery site.

10. An improved coiled article retaining assembly as in claim 2 wherein said distribution means comprises a multi-plug electric outlet.

11. An improved coiled article retaining assembly as in claim 9 wherein said distribution means comprises a multi-plug electric outlet.

12. An improved coiled article retaining assembly as in claim 10 wherein said multi-plug electric outlet includes a light source.

13. An improved coiled article retaining assembly as in claim 11 wherein said multi-plug electric outlet includes a light source.

14. An improved coiled article retaining assembly as in claim 12 wherein said light source is universally mounted on to said main body portion so that said light may be directionally oriented by the user.

15. An improved coiled article retaining assembly as in claim 13 wherein said light source is universally mounted on to said main body portion so that a light beam may be directionally oriented by the user.

16. An improved coiled article retaining assembly as in claim 12 wherein said light source has means for regulating the brightness level of light desired.

17. An improved coiled article retaining assembly as in claim 13 wherein said light source has means for regulating the brightness level of light desired.

18. An improved coiled article retaining assembly as in claim 8 wherein said distribution means comprises a sprinkler head and the coiled article is a hose.

19. An improved coiled article retaining assembly as in claim 9 wherein said distribution means comprises a sprinkler head and the coiled article is a hose.

20. An improved coiled article retaining assembly as in claim 18 which includes:

(a) means for stabilizing said body attachable thereto for balancing the retaining assembly against the force of fluid pressure being delivered through the hose and sprinkler head.

21. An improved coiled article retaining assembly as in claim 19 which includes:

(a) means for stabilizing said body attachable thereto for balancing the retaining assembly against the force of fluid pressure being delivered through the hose and sprinkler head.

22. An improved coiled article retaining assembly as in claim 20 wherein said stabilizing means comprises a stand member having a wide base to support the retainer assembly in a non-tip fashion when in use at the delivery site, and at least one clip disposed to detachably engage one of said side margins of said main body.

23. An improved coiled article retaining assembly as in claim 21 wherein said stabilizing means is a stand member having a wide base to support the retainer assembly in a non-tip fashion when in use at the delivery site, and at least one clip disposed to detachably engage one of said side margins of said main body.

24. An improved coiled article retaining assembly as in claim 18 which includes:

(a) a prong member attachable to said body;

(b) said prong member having a first, up position and a second, down position;

(i) said prong being substantially flush with said body in said first, up position; and (ii) said prong being engageable with the ground to anchor said coiled article assembly when in said second, down position.

25. An improved coiled article retaining assembly as in claim 19 which includes:

(a) a prong member attachable to said body;

(b) said prong member having a first, up position and a second, down position;

(i) said prong being substantially flush with said body in said first, up position; and (ii) said prong being engageable with the ground to anchor said coiled article assembly when in said second, down position.

26. In a coiled article retaining assembly having a rigid body adapted to removably retain a separate, unconnected coiled article, said coiled article having a first terminal end member adapted to be disconnectably connectable to an initial power, fluid or signal source, an intermediate coilable portion, and a second terminal end member being adapted to serve as a remote outlet at a delivery site, said body having a coil-receiving elongated coil storage slot dimensioned to prevent cross coiling and to prevent lateral passage of at least one of said terminal end members, and said slot having an opening adjacent said forward end margin of said body including means for regulating coil passage into or out of said slot, the improvement in said coil passage regulating means comprising:

(a) a flap-type keeper assembly having a bi-directional differential coil insertion/removal resistance, which resistance is less for coil insertion than coil removal, said coil removal resistance including a restraining force sufficient to prevent a stored coiled article from spilling out of said elongated slot due to its own weight when said assembly is in an inverted, keeper-down position, but said coil removal restraining force is easily overcome by a minimal additional force provided by a user to permit coil by coil metering out of said coiled article without total unloading of all coils at once.

* * * * *